United States Patent [19]

Bern

[11] Patent Number: 4,632,399

[45] Date of Patent: Dec. 30, 1986

[54] MANIPULATIVE CHALLENGE

[76] Inventor: Zelany R. Bern, Ste. 306, 1559 Rockville Pike, Rockville, Md. 20852

[21] Appl. No.: 649,475

[22] Filed: Sep. 11, 1984

[30] Foreign Application Priority Data

| | | | |
|---|---|---|---|
| Sep. 12, 1983 | [IS] | Iceland | 2852 |
| Sep. 12, 1983 | [IS] | Iceland | 2853 |
| Oct. 3, 1983 | [NZ] | New Zealand | 205838 |
| Sep. 6, 1984 | [IS] | Iceland | 2942 |

[51] Int. Cl.[4] ..... A63F 9/08

[52] U.S. Cl. ..... 273/155

[58] Field of Search ..... 273/153 R, 153 S, 155, 273/156

[56] References Cited

U.S. PATENT DOCUMENTS

| | | | |
|---|---|---|---|
| 3,128,100 | 4/1964 | Sinden | 273/153 R |
| 3,637,215 | 1/1972 | Keister | 273/156 X |
| 3,637,216 | 1/1972 | Keister | 273/156 |
| 4,357,016 | 11/1982 | Allison | 273/156 |

*Primary Examiner*—Anton O. Oechsle

[57] ABSTRACT

A manipulative puzzle is disclosed in which a succession of coaxial wheel-like elements is to be moved by a projective pattern to selectively exclude ones of these elements from a lot to be rotated in relation to the others. An embodiment has a disassembled configuration in which the various self-integrating parts comprise a semi-tubular limiter adapted for educational use in the assembly of a compact annular body from initially isolated elements, and an actuative projectional unit. The equable arbor able to provided by this limiter and the range of moves able to be performed unite conceptually the broad style of its puzzle with simpler apparatuses made to challenge a toddler. In addition this actuative projectional unit is selectively installable to determine the complexity of its puzzle.

21 Claims, 17 Drawing Figures

MANIPULATIVE CHALLENGE

The following apparatus takes the form of a toy and serves the object of providing a facility to make light mechanical mathematical problems. The player should randomise the apparatus with approximately one dozen successive operations, each such operation having a first phase and a second phase, and then endeavour to cancel the effect of each such second phase in the randomisation.

The relevant prior art comprises U.S. Pat. No. 4,357,016. The contrivance which is its subject has an illustrative embodiment comprising two bodies, one forming an annular sleeve around the other in assembly. A member or members of this annular sleeve may be selectively rotated about the other body but such rotation is not generally accompanied by any significant effect in the other body, which itself then forms a cylindrical support and integration means for the sleeve. This support is neither even at its principal round outward side, nor uniform as it is regularly rearranged by the player, nor does it have a uniform effect upon the rotations of the sleeve members, and in these ways lacks equability. The members of the other body are themselves slid in relation to one another longitudinally of the common rotational axis to prepare the way for rearrangements of the sleeve, and apparently the solution method bears little relevance to elementary mathematics.

Although there is a conceptual link between my invention and the device of U.S. Pat. No. 3,659,854, nevertheless the range of available moves and the style of construction are quite different. With reference to claim 1 of U.S. Pat. No. 3,659,854, you may find, in my apparatus, more than three actuators, each such actuator associated with a different group of annular indicative elements. However, not each operation of such an actuator changes the setting of each element in its associated group. I refer to an array of annular indicative elements in my apparatus as 'the indicator', rather than calling each such element 'an indicator'.

In the contrivance of U.S. Pat. No. 3,637,216 teeter bars are coaxially mounted on a simple axle at an exclusion facility which does not seem to directly causally interact with them, and which is definitely non-rotational internally of itself.

In further consideration of the prior art, I draw your attention to the existence of my unpublished provisional specifications and the respective dates on which they were filed with the New Zealand patent office; Nos. 198828 (2/11/81), 199802 (23/2/82), 200147 (26/4/82), 200625 (17/5/82), 201339 (21/7/82), 202050 (1/10/82), 202864 (21/12/82), 203154 (2/2/83), and 204033 (28/4/83). These have all been abandoned due to inactivity in following them with complete specifications. They all relate to concepts involved with the invention, as does provisional specification number No. 205838, filed in New Zealand on 3/10/83, on which I seek some priority.

In the apparatus I utilize what I believe to be a novel semi-tubular limiter to pin the annular elements of the indicator together. This limiter could apparently be useful for educational purposes at a lower learning level than that to which the complete apparatus is related.

One of the first things children should learn in the field of mathematics, is how to use the words 'first', 'second', 'third', and so on. Currently, a device is available which comprises a relatively large often wooden foot and a linear vertical post embedded in the foot. Supplied therewith are ordinarily annular elements of different sizes which may be placed on the device by inserting the post through their respective bores. By this means a line of elements is makeable, and styles like 'the first ring from the foot' may refer. As the order of the elements in the line is variable, the idea by which styles of order refer is differentiable from the idea by which styles of size, like 'the largest ring on the post' refer.

For mounting annular elements in a line, my limiter has the advantage that it integrates the line in a variety of attitudes, and the integrated line may be easily carried. Although the annular elements of the indicator are congruent, they may be of different colours so that styles of order can be compared with styles of colour. In addition, they may be peripherally marked with letters so that, by varying the arrangement on the limiter, words comprising such letters could be registered along a line parallel to the common axis, in exercises related to spelling.

The limiter may achieve its efficacy by incorporating resilient members, or by being permanently integrated with such members, however, its resilience is not a necessary feature. It does provide an equable arbor, or an equable foundation for the annular indicative elements, and preferably has an arched inward surface which delimits a space ringed by the indicator. A fence or guide member passes through this space, so that in said first phase the indicator may be selectively placed at an obtaining projective pattern which restrains protuberant markers of the indicator, limiting some of the annular elements more particularly against a first long member, and the others of the indicator against a second long member, so that when these long members are moved relative to each other in a direction normal to the rotational axis in said second phase, two modes of said elements are discernible.

Zones successive longitudinally of the rotational axis are associated by the obtaining projective pattern, each with a unique one of said modes, and this association should remain in force, even if it is changeable as is the case with one of the embodiments, for the duration of each interval of activity in which said randomisation is followed by a successful endeavour to cancel as mentioned. Since at the close of said first phase, each of said elements is largely in a unique one of said zones which it will remain in for the duration of the ensuing second phase, it will have the mode associated with this zone during the ensuing second phase.

Each of said elements includes a symmetrical annular array of said markers, so that when it is rotated by 360 divided by m degrees in the indicator, there occurs a symmetrical change of markers. (m is an integer greater than or equal to 3 and stays constant with the subject, namely the indicator in which this element is installed.) The transition which accompanies said second phase substantiates such change. Barriers of the obtaining projective pattern are spatially distributed over a row or rows aligned parallel to the rotational axis; movement of the limiter along the fence or guide in the first phase is a means whereby such barriers pass in respective selections of the places resembling keyways which exist by means of said markers.

The indicator consists of annular elements having a common style chosen from the following four:

(a) There is an element at which each barrier of the kind proposed one installs to act from within the element's axial passage or bore.

(b) There is an element at which each barrier of the kind proposed one installs to act, through a member extending by the outward side of the indicator, by readiness to engage a marker which is a showable nodule of the element. After the brief initial description of the drawings, an embodiment using such an element is described first, but is not the preferred embodiment.

(c) There is an element at which one installs, in respectively different moments, a barrier of the kind proposed to act from inside the element's axial passage or bore through a singular fence, and a different barrier of the kind proposed to act through a peripheral base on an ideally flat facet of the element pointing away from the rotational axis. A pertaining embodiment of the invention is described in details following the description of the preferred embodiment.

(d) There is an element like that of (c) above, except where recesses have been formed at the outward side of the element which is thus adapted to directly engage narrow barriers of the kind proposed for the element described in (b) above.

Sophistication of the pertaining challenge may be achieved when the projective pattern has been prepared so that during said second phase, one of the long members readily communicates moves to ones of said elements separated in the indicator by another one of said elements discernibly not concomitant. The facility whereby the player may select the long member so designated simply by moving the limiter parallel to the common axis is considered to be a novel feature of the invention.

The two long members are rotatably interconnected, and in order to execute said second phase, the player may apply torque directly between them. Where elements as described in (a) or (c) above are used, it is often more handy however to apply the torque to elements of the indicator.

The utilization of combinations of barriers to communicate moves is, of course, made possible by the special relations of the parts. Without the complete indicator, which is typically a compact when it is installed on the limiter, it would be awkward to largely confine each annular element thereof to a single one of said zones for the duration of said second phase; ordinarily such confinement is easily achieved by the player simply by holding the limiter still on the singular fence, or if there is more than one fence, by holding it still on one of them, and static longitudinally of the rotational axis in relation to them both.

DESCRIPTION OF DRAWINGS PROVIDED WITH THIS SPECIFICATION

FIGS. 1 to 7 in a partly freehand style show: at 1, a peg, and at 2, a plastic handle incorporating a long member; at 3, a further long member for mounting with the member shown at 2 by means of a fence which is illustrated at 4; at 5, a planar trace (this style of drawing is explained below) of an assembly; at 6, a view in substantially orthographical style from the end of an assembly; and at 7, the same assembly which is shown at 8 but viewed from above.

FIG. 8 was made by isometric projection to show some of the parts of the preferred embodiment.

When I refer below to the second direction embodiment, you could imagine FIGS. 9, 10, 11, and 15 to be marked as clocks facing toward you. The second direction is then clockwise at 9 and 15, whie anti-clockwise at 10 and 11.

Figure 13:
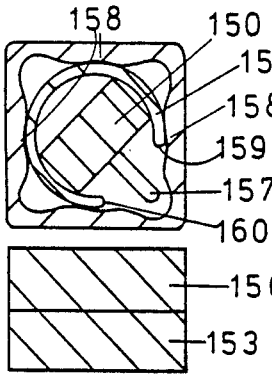
FIG. 13 is a cross-sectional view of the embodiment shown isometrically at 14, which embodiment utilizes elements as described at (c) above.

The style of drawing I call a planar trace is such that in each planar trace of this specification I show only surfaces which actually cut an ideal plane (common to the drawing as a whole) orthogonal to the rotational axis of its subject. FIG. 13 depicts not only such intersections but also features which do not cut the plane, such as 157.

Secondly after the preferred embodiment, I prefer one shown at 13 and 14, and in order of preference the other depicted contrivances are the one shown at 1 to 5, and the one shown at 6 and 7.

DESCRIPTIONS WITH REFERENCE TO THE ACCOMPANYING FIGURES

With reference to 1,2,3,4 and 5, one embodiment comprises the long member 30, the long member 31, a fence or guide member 32, and a plurality of at least eleven small pegs. Each such peg comprises semi-cylindrical, resilient, round-pointed, generally parallel, spaced apart bodies 33s which are permanently attached to a larger head 34, which head should be gripped by the player to insert, for security, the peg into any one of the at least twenty-two congruent apertures which will be distributed over two regularly ordered rows. Member 30 defines one of these rows while 31 defines the other. Members 30 and 31 will be rotatably integrated through pivot pins 36 and 37, which pins are aligned with each other to define the common axis of rotation. Pins 36 and 37 are bonded into respectively different ends of the fence 32 which is rigid and mainly linear to manifest a smooth track for the limiter 38. The arched inward surface of 38 conforms to the cross-sectional configuration of 32 to hold the axis of rotational symmetry of the annular elements 49s virtually collinear to the common central line of 36 and 37.

Members 30 and 31 incorporate enough resilience just to allow the installation of 32 between flanges 39 and 40 at respectively different ends of 30 and then between flanges 41 and 42 at respectively different ends of 31. After this installation, 36 will pass through apertures 43 and 44, while 37 will pass through apertures 45 and 46 to make 30 rotatable about the common axis relative to 31. To facilitate ease of operation, 31 comprises an earlike handle 47 at each of its ends and 30 comprises a contoured plate 48 which usually would project toward the player in operations and which the player would support between fingers of the writing hand, while using the thumb and index finger of that hand to hold the indicator.

In this embodiment the markers of the indicator are cogs or nodules 50s which may be of different colours to enable the player to identify a certain state of the indicator as the solution state. In the assembly the indicator is confined such that 30 and 31 continually extend right across it longitudinally of the common axis, and 30 and 31 are closely mutually engaged longitudinally of this axis to compose an exclusion facility in which each barrier of the kind proposed by paragraph (b) above consists of the two 33s of one of the pegs held by their resilience, without assistance by the player beyond initial insertion, in one of the long members 30, 31.

In the embodiment shown at 6 and 7 the internally rigid first long member comprises projective handling plate 67, a rather reflexive guard 72 which curves around the indicator's periphery to subtend about one hundred degrees at the common axis, a linear central fence 63 and a dense consolidator 65 which joins 67, 72, and 63 together at one end only. The internally rigid second long member comprises wheel 64 rotatably bolted to 65 for rotation relative to 65 about the common axis, and a barrier-holding, rebated tube 61, which is rotationally confined between outwardly protruding stop 70 incorporated with 65, and the upper edge of 72, which edge is generally parallel to the axis and readily abuts with the ridge-like barriers incorporated with 61 at 68 and 69 respectively. Thus the concavity of 61 is kept in contact or virtual contact with the outer convex side 72, and said second phase can only be performed with a single change of each marker 71 which is not concomitant with the long member designated to communicate moves as said.

When the indicator consisting of seven coaxial elements 66s as described in paragraph (b) above is positioned for the second phase as shown at 7, the first long member comprising 67 is designated as described, by means of its portion 62 extending right alongside the indicator and holding ridge-like barriers which transgress the respectively different zones between 65 and 68, and between 68 and 69.

The limiter 38, also utilized in the embodiment shown at 1 to 5, is moulded as a single unit; the two separated members thereof which are visible at 5 are resilient to permit the indicator to be installed and contribute to the journal of the indicator which allows trouble-free manipulative rotation of each 66 by degrees fully 360 degrees about the common axis.

In the embodiment shown at 6 and 7 the indicator is confined to 63 after randomisation until the player has assembled a full row of larger places 75 resembling keyways in alignment with obstruction means 74. The markers may be embellished to indicate to the player when such a row is existent. Each 75 is one of the five places resembling keyways defined by one 66 and the other four of these places, like 76s are too small to be installed on 74 in the assembled configuration.

Figure 1:
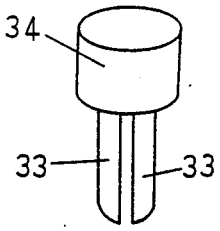
Figure 2:
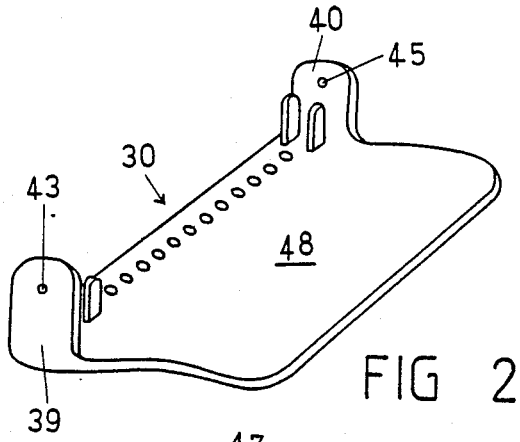
Figure 3:
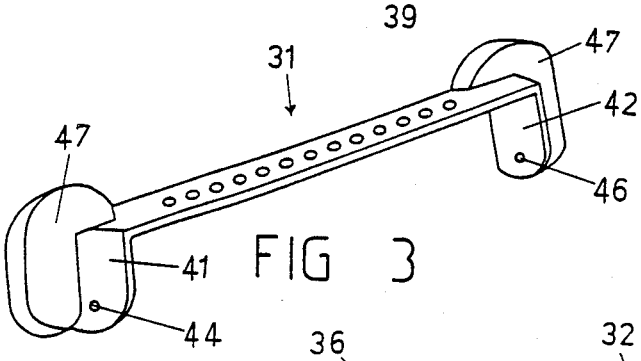
Figure 4:
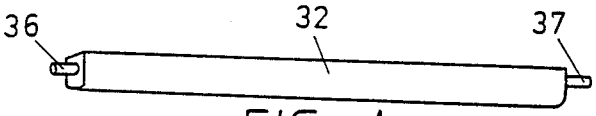
Figure 5:
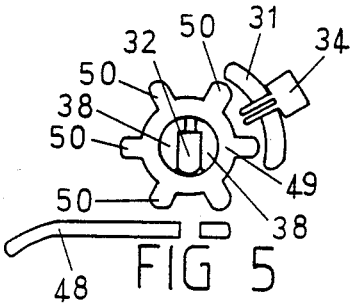
Figure 6:
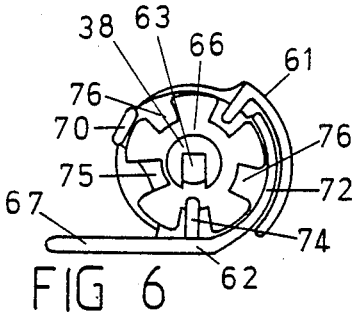
Figure 7:
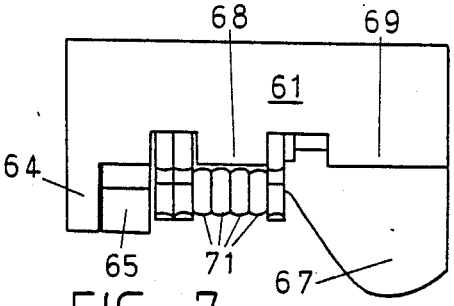

FIG. 7 shows the embodiment virtually true to life size.

The semi-tubular limiter depicted at 8 is associated with an inwardly protuberant ridge 78 required for the full preferred embodiment, and is designed to pin the annular elements together in a coaxial compact array thereon between lip 84 and lips 85,86. Lips 85 and 86 are held by the resilient members 87 and 88 respectively which should be pressed toward each other in mounting such annular elements on the limiter or removing them from it.

Disregarding 78, the limiter is injection-moulded as a single self-integrating unit comprising 85,86,87,88,79, and the consolidating section 77 which holds lips 84 at the end opposite 85 and 86. It should be formed to have the same resilience and flexural strength as a congruent device made by rebating a length of unplasticised PVC pipe of uniform, generally circular cross-section, and of uniform thickness of material being 1.2 millimeters, to make gap 89 defined between sides 91 and 92 extending the entire length of this device parallel to the pipe's axis, and to make slits 93 and 94; and by fixing the rebated tube to the lips 84,85 and 86. The resting configuration of the limiter, in which it can provide an equable foundation for each 114, while pivoting such elements as may be mounted thereon for rotation relative thereto is described in the following paragraph. p The cylindrical outer surface which shall form the journal for the elements 114s has a radius of approximately thirteen millimeters. Sides 91 and 92 make gap 89 to subtend generally about ninety degrees at a line; 84 is an unbroken, major section of a full circular ring which section subtends approximately 270 degrees at said line and is incorporated with 77 so as not to transgress the region comprising 89, which region lies between mutually perpendicular ideal planes meeting in said line; 93 and 94 generally subtend about three degrees each at said line and communicate with both the outward and inward sides of the limiter to divide it along half its length (parallel to said line) into the three members which are 87,79 and 88 appearing in that order in the second direction; 79 is generally parallel to said line and generally subtends 105 degrees thereat. Each of the angles mentioned in the previous sentence is subtended in a plane orthogonal to said line which line is representable by a straight line collinear with the arrow at 90, and becomes the axis of rotation of rings pinned on the limiter. Member 87 is congruent to 88, and 85 is congruent to 86. The side of each of 84,85, and 86 which will face toward the 114s pinned between them is generally flat, smooth and perpendicular to said line, with however, its upper 141 being non-obtrusive and slightly round overall. Lips 85 and 86 taper off at their respective proximities to 79 such that they are not disposed to catch on 79's edges when simultaneously pressed toward said line, and they do not transgress the region mentioned in this paragraph above. Further, 84,85 and 86 are three rigid pieces projecting radially away from the journal just 2.5 millimeters each.

The consolidating section 77 is itself a semi-tubular limiter, however in the following description I use the number 77 for the whole component comprising 84,85,86,87,88,79 and said consolidating section.

With the preferred embodiment a number of rigid components are provided, and 77 must be fitted with 78. When the preferred embodiment is assembled, two fences pass through the space ringed by the indicator, one being outwardly convex so that a part of 77's inward arched surface, of which all points are then kept virtually equidistant from said line, is able to rotate thereon about an axis virtually collinear said line, and also to slide thereon. The other fence defines a long continuous groove 136 in which 78 is slidably engaged so that this other fence is then held rotationally fast against 77. These two fences shall be rotatably connected with spindles and consolidators to delimit their positions, while 78 is linear, extends slightly less than half the length of 77, and is firmly bonded to 77's inward aspect to station it (78) generally parallel to said line. The other components comprise a delayer means, six only congruent annular elements 114s, and projectional units.

The first long member comprises a circular semi-cylinder 105 being the fence which rotates on 77, a ridge 106 firmly bonded to the entire length of 105's concave surface while extending generally parallel to the axis mentioned in the immediately preceeding paragraph, a rigid spindle 107 (having the rigidity of a linear mild steel rod of 3 mm cross-sectional diameter), and a consolidator 108 which joins 105 and 107 at a first end of the apparatus. I refer to this axis as Q and have indicated Q at FIG. 8. Q is the best longitudinal centre line for 107 and passes through the centre of the recess 104 which is defined by 108 in its side facing away from 107.

Parts 105,106,107 and 108 are integrated in a single internally rigid component.

The second long member comprises consolidators 110 and 113 spaced apart by the grooved fence 112. 110 holds a short spindle 111 which is shown at 8 by dotted lines as it is obscured, and 113 holds another short spindle 120, these two spindles protruding toward each other and being aligned on Q in the assembled form. Parts 110,111,112,113,120, and the protruding obstruction means 133 are integrated in a single internally rigid component.

Said delayer means comprises a lip 121, a hard lump 122, and a protruding obstruction means 123. Lip 121 is a short circular semi-cylinder with an outer radial extent equal to 105's, and in the assembled form is closely packed between 105 and 113 at a second end of the apparatus with an end of 107 then being seated in the fitting recess 124. Recess 124 is defined by 122 such that its central line is collinear with the axis of the annular space half occupied by 121, and will thus be aligned on Q in the assembled form.

Figure 17:
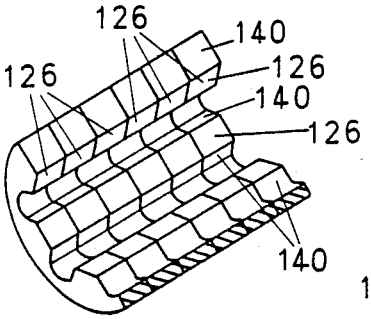
FIG. 17 is an isometric section of the indicator of the preferred embodiment arranged to make rows of its inwardly protuberant markers.
Figure 15:
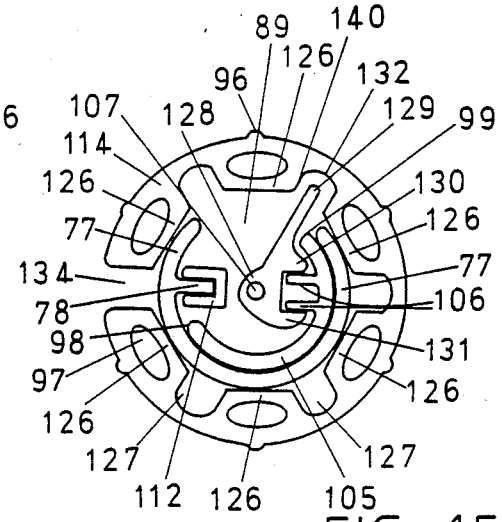
FIG. 15 is a schematic planar trace of the preferred embodiment assembled.
Figure 16:
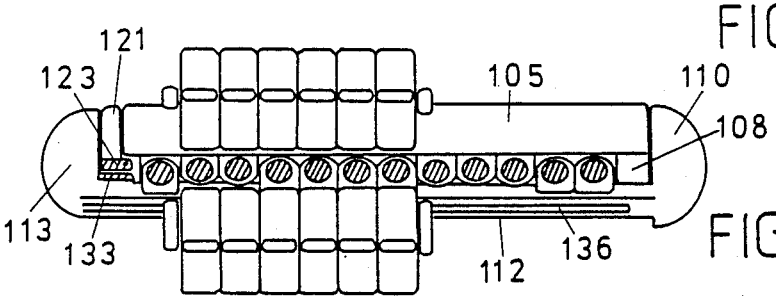
FIG. 16 is a partly freehand drawing of the assembled preferred embodiment, shown from above immediately following its assembly and before commencement of its randomisation. At 16, only the uppers of the barriers of the projective pattern are visible and these have been highlighted by shading them with diagonal lines.

The position of 121 installed is clearly shown at FIG. 17 whereat 107 is obscured by projectional units packed on it. Here it may be seen that by sliding the limiter with indicator as a singleton internally settled, relative to 105, the player may selectively exclude elements of the indicator from the lot which will have one of said modes in the next second phase.

Consolidators 110 and 113 shall have round flat faces orthogonal to Q which shall rotatably abut respectively with said facing away side of 108, and a flat face of said delayer means, which face meets the walls of hole 143 so that 143 appears as a deep routed groove in it extending from Q radially outward to meet side 137 of said delayer means.

Recess 104 comprises a cylindrical recess which permits slight, but minimal, movement of the spindle 111 when fitted into it, laterally of Q.

Eleven congruent, rigid, self-integrating projectional units are provided with this embodiment, each such unit comprising a rigid hub means which includes an annulus 128 defining an axial orifice through the unit, a prominent barrier 129, and a joining means comprising lugs 130 and 131 between which lugs is defined a recess peripheral to the hub means.

When preparing a projective pattern to make a puzzle, the player should grab the first member which will be for a moment isolated from the other components, including the six congruent elements 114s, and then taking said projectional units one by one, should insert the second, or then free, end of 107 into axial orifices to slide them into their respective serial positions on 107. Upon so mounting each such unit, the player should choose, or may be instructed, to mount it in one of the two attitudes available for each.

According to the first of these attitudes, 130 and 131 project toward the concavity of 105 and abut with 106 which fills or essentially takes up the recess between them so that the unit is rotationally locked onto the first member while 129 projects radially outward.

According to the second of these attitudes, at least one of said lugs projects away from the concavity of 105, allowing the unit to rotate on 107 about Q in a non-sloppy fashion by degrees, relative to 105 and 107, while 129 continually projects radially outward. Ridge 106 faces a round surface of the annulus 128 of each unit installed in this second attitude and is slightly spaced from this surface, the surface itself being closer to Q than the flat terminating side of the recess between 130 and 131. This terminating side spans the recess from one lug to the other, and in common with the mutually facing sides of these lugs, is stationed parallel to Q in the assembled form. Ideally, the recess has a generally rectangular shape to ensure unequivocal rotational engagement of the fence 112, which should have a fitting rectangular form, and each unit installed in this second attitude.

Figure 8:
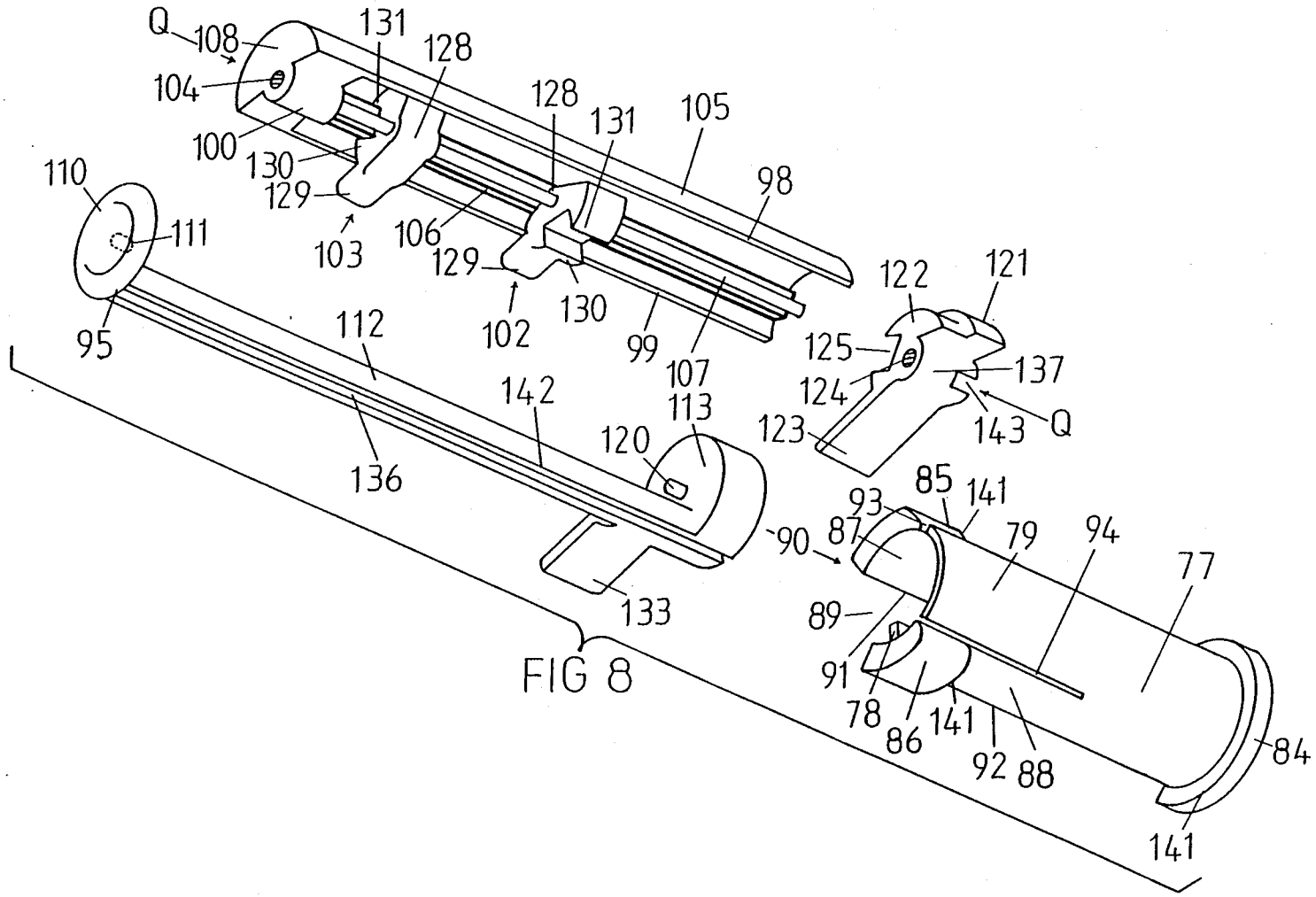
Figure 9:
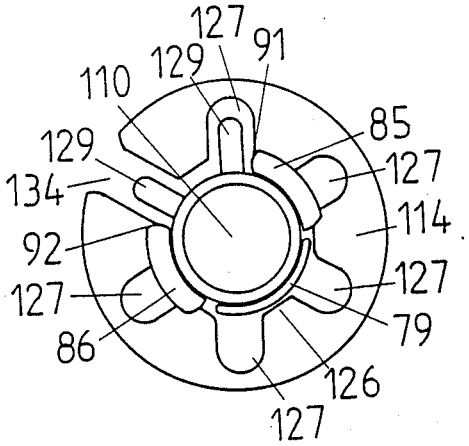
FIGS. 9 and 10 show the respectively different ends of an assembled form of the preferred embodiment and were drawn orthographically.
Figure 10:
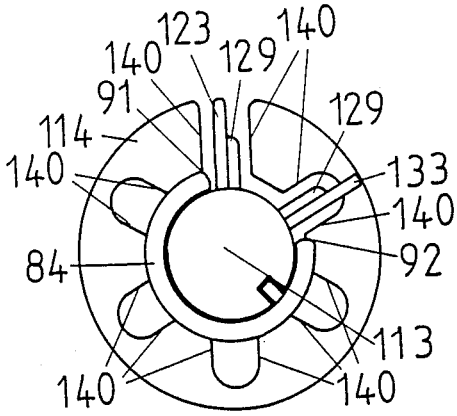
Figure 11:
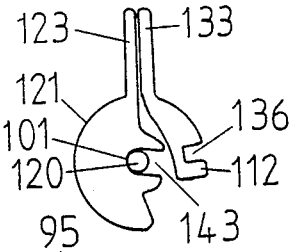
FIG. 11 is a planar trace of the assembled form of the preferred embodiment which is shown isometrically at 12.

At FIG. 8, a projectional unit in the first of said attitudes is indicated at 103, while one in the second of said attitudes is indicated at 102.

Acutely sharp edges on these units should be avoided, especially at their sides of mutual abutment, to ensure that any number in the second attitude, packed closely between two in the first attitude, can still be easily rotated in unison relative to 105 on 107.

When all ones of said projectional units have been packed along 107, the player should install said delayer means with 122 extending forth alongside, and then meeting, the concave surface of 105 for a small distance measured parallel to Q, five millimeters just. Thereupon 121 will abut with the second end of 105 and said projectional units will be closely packed between 108 and 122. Also 106 will extend into the recess 125 defined by 122 whereby said delayer means is prevented from turning about Q relative to 105 in the assembled form. Conductive toward this rotational interlocking is the extent to which 122 shall contact 105 at junctions curved around Q, between which junctions shall be the second end of 106. These junctions shall subtend a total of at least 125 degrees at Q.

The player should then lay 112 generally parallel to Q while installing it between the lugs 130 and 131 of each unit in the second of said attitudes. But the engaging of the second member to the first should begin with the placement of 111 into 104 and should be finished with the movement of 120 through hole 143 at side 137 of said delayer means, to make the first member, said projectional units and said delayer means mutually, closely engaged between 110 and 113 longitudinally of Q. The short spindle 111 need not project into 104 any more than a mere one and one half millimeters to ensure its constant alignment on Q during operation of the assembled form, but there should not be enough latitude to allow the player to after displace 111 away from Q without first lifting 120 through 143 along a path transverse to Q.

The legend at 12 which takes the form of a sequence of binary digits below the main drawing is intended to indicate the nature of the projective pattern obtaining in the subject of the drawing. In this subject each of said projectional units is the singleton of its kind impounded within one of a sequence of congruent annular zones bounded by respective ideal planes orthogonal to Q.

In the assembled form the six elements 114s should be held compactly on 77 through 84,85 and 86 without being squeezed together in a way that would make restrictive friction between the adjacent ones. To illustrate: In the practice embodiment I could manually squeeze them together and then move them as a singleton longitudinally of Q on 77 from abutment with 84, through two millimeters just, to abutment with 85 and 86 simultaneously. Clearly, the berth for the elements between 84 and 85 should measure in parallel to said line the same as the berth for them between 84 and 86; it also measures in this way six times the extent, longitudinal of Q, of each of said congruent zones.

On the same perpendicular bisector of Q as each O of the legend is shown, or obscured from view as the case may be, one of said projectional units more particularly secured (in the second attitude) on 112, while on the same perpendicular bisector of Q as each 1 of the legend is shown or obscured one of said projectional units secured more particularly to the first member. Thus a binary sequence as the legend may be used to inform of the association between said modes and said zones, any 114 placed largely in a "0" zone for the duration of said second phase having one of said modes, while any 114 then placed largely in a "1" zone has the other mode.

In order to make a non-trivial puzzle for mature intellects the player could arrange said projectional units so that the informative binary legend telling like the legend at 12 has the form $k_1k_2k_3 \ldots k_{2n-2}k_{2n-1}$, the matrix $$\left\{\begin{matrix} k_1k_2 & \ldots & k_n \\ k_2k_3 & \ldots & k_{n+1} \\ k_3k_4 & \ldots & k_{n+2} \\ \cdot & & \cdot \\ \cdot & & \cdot \\ \cdot & & \cdot \\ k_nk_{n+1} & \ldots & k_{2n-1} \end{matrix}\right\}$$

having a multiplicative inverse, land $k_1k_2k_3 \ldots k_{2n-2}k_{2n-1}$ comprising two runs of Os alternating with two runs of 1 s, each such run consisting of no more than four binary digits, whereas $n=6$ for the illustrated embodiment. Then moves could be communicated in the manner outlined and mathematical solution methods will yield a solution unique, not in the order which the required moves should be performed to return the solution state after the initial process of randomisation comprising operations as said dozen, but in the minimal number of times a rotational conditioning to cancel the effect of the second phase of one of said operations should be done at each of the available stations for the indication in said sequence of zones. A set of equations associated with an informative binary sequence for one of the makeable projective patterns may be provided with the apparatus to assist the player in finding such a solution with instructions about determining values for the mathematical variables of these equations.

The preferred embodiment may be assembled by a player without any of said projectional units on 107 at all and in this form may provide an amusement and a challenge for a toddler progressing from the assembly of annular elements on 77.

Reference 11, the seat for 120 is part of the linear radial hole 143 which hole is defined by said delayer means and terminates with a semi-cylindrical concave surface 101 which rotatably abuts with 120 in the assembled form. Side 137 of said means is outward, convex, and is posted adjacent to 112 in the assembled form, while at the other end, 112 is adjacent to side 100 of 108. Fence 112 should be able to pass clear of both 100 and 137 as it is rotated in a non-sloppy way between the following two points, by degrees.

(1) There shall be a first point at which all the barriers 129s shall be aligned in a row. Each such barrier shall then abut or virtually abut with the long edge 99 of 105, held parallel to Q.

(2) There shall be a second point at which 112 shall abut with the other long edge 98 of 105. The position of 78 should be such that, at this point, side 91 of 77 shall not be forced against barriers of the first attitude to prevent it from being easily slid along 105. Nevertheless at this second point 91 should be readily close to any such barrier 129 of the first attitude. Side 91, incidentally, borders member 87.

Given the assembled form, fence 112 fills, except for groove 136, the recess between 130 and 131 of each of said projectional units in the second attitude, while projecting a little outward therefrom to create a long lip generally parallel to Q which lip is the part of 112 which shall abut with 98 at said second point, and is bordered by edge 142 which shall be adjacent to 88.

The player may position the assembled form between palms while holding the indicator, and then select a station for the indicator by pushing either 110 or 113 with the adjacent palm.

Each element 114 comprises no more or less than six markers 126s whereby five standard congruent places resembling keyways 127s and one larger place 134 will be defined by the element. With reference to 9, each 127 and each 134 lies between sides 140s equally spaced from and largely parallel to an ideal plane containing the geometrical axis of rotational symmetry of the maximal annular array of 126s in the element. This axis is held virtually collinear to said axis at 90 and also to Q throughout operations of the assembled form, by mutual fit of the components.

Each 114 has two smooth flat annular faces which in the assembled form are kept at 77 virtually orthogonal to said line. These two faces are generally 9 mm apart, form the respective limits of the 114's width overall, and are disposed by a solid ring part of the 114 which holds the six 126s each extending from one of these faces to the other. Economies of material could be achieved by causing depressions to be defined in one of these faces of each 114, such as indicated by the oval area 97 at 15. In addition, peripheral ridges such as 96 shown at 15 could be formed as a means of grip enhancement for the player.

Preferably 134 is open in the outward annular rim of its defining element 114 and thus communicates directly with the surrounding peripheral space in which handling of the assembled form occurs.

After mounting the 114s on 77 (while 77 is isolated from the first and second members) the player should now align all 129s by positioning 122 at said first point, whereupon 123 and 133 should be contiguous to make an obstruction which he/she should pass through each 134 as 78 is entered into groove 136 outwardly defined by 112. This obstruction is then aligned with all 129s and 133 should directly precede 123 in the second direction. The side of this obstruction closest to said first end should be generally orthogonal to Q and contiguous to the first one of said congruent zones without actually transgressing its space. This obstruction is apparently a symmetry by reflection in an ideal plane containing Q, which plane separates 133 from 123.

With reference to the indicator which has been thus installed, the Q-facing surface of each 126 which surface contacts the outer surface of 77 during operations, is flat with slightly round edges whereby it will not catch on either 91 or 92 in rotation over 77.

While 136 is kept still with 112 at any one of said points, each 114 can be put largely within any one of six consecutive ones of said zones by sliding movement of 78 parallel to Q in 136.

The apparatus is designed to give the player latitude with stationing the indicator prior to conditioning a selectively exclusive lot of 114s with rotation. Such latitude shall obtain due to these characteristics.

In the assembled form, each 128 spans its allocated zone and is in contact with its adjacent 128 or 128s, however the incorporated 129, should span only seventenths of the allocated zone longitudinally of Q and should be stationed centrally, by longitude of Q to the zone. Further, each side 140 should extend by longitude of Q sufficiently to 95% span any one of said congruent zones in which it could be installed for said second phase or an equivalent.

Reference, a small space or gap should obtain between the zenith of each 129 and the overpassing Q-facing surface 132 of any 114 with a 127 on the 129 so that facility in selecting rotational limitations consistently obtains by sliding 77 along the fences if 112 is placed at any one of said points. Because 112 is generally parallel to Q of each of these points, and stays parallel to Q in rotation from one point to the next, no more than two non-aligned rows of barriers 129s are made by operations of the assembled form, as or equivalent to, said dozen. The player conditions said lot in executing said second phase by rotating 112 relative to 105 about Q through 60 degrees just; because of the regular distribution of the markers in each 114, each row of 129s which exists when 112 is in said second point is readily aligned with a row of places resembling keyways without further rotational movement of 112; this rotation of 60 degrees amounts to a transition between states in which 112 is posted at the respectively different points mentioned above.

Reference 10, 123 and 133 jut out too far for the player to install them either singly or together in any 127, in the assembled form. Either 123 or 133 is ready to abut with any 114 in said first congruent zone, to prevent the player from removing the indicator, unless said obstruction comprising 123 and 133 is made and the 134 of the element aligned therewith, parallel to Q.

An obstruction at said first end, which obstruction is non-removeable in the illustrative embodiment, prevents the player from removing the indicator from the assembled base by sliding 77 past the first end. Typically, this obstruction is ready to abut with 77 or 78 and as shown (reference 8 and 12) comprises a closure 95 of the groove 136, which closure abuts with 78 if the 114 closest to 111 is stationed completely in the eleventh one of said congruent zones from 123. Other forms or positions of obstruction at the first end to perform this task may apparently be devised as would be clear to those skilled in the art, and I suggest one interesting alternative later.

The rigidity of 112 prevents improper removal of the indicator that could be attempted by positioning the indicator in the assembled form at said first end and then forcibly bending 112 away from Q at said second end to release said delayer means. The ridge 78 and groove 136 combination is also conducive to preventing such improper removal; in the assembled form 78 should be engaged deep enough in 136 such that it can not be manually lifted out of it except by sliding it therealong and moving it through the opening to 136 at 113.

In the assembled form the 114s ring 77, 112 and 105 to make 77 a pivoting means for 112 relative to 105. Concomitant with this state of ringing, said resting configuration of the limiter is maintained in existence to effect the impounding of the 114s on the semitubular limiter despite any attempt by the player to squeeze 85 and 86 toward each other; such attempts shall be fruitless because 87 and 88 shall be held apart by the assembled sum of the first and second members.

Nevertheless, the player will be able to move an end of 77 past 113 before a full row of six 134s has been assembled, and so the apparatus should be designed so that in assembly 85 and 86 are placed closer to the first end than 84.

Figure 12:
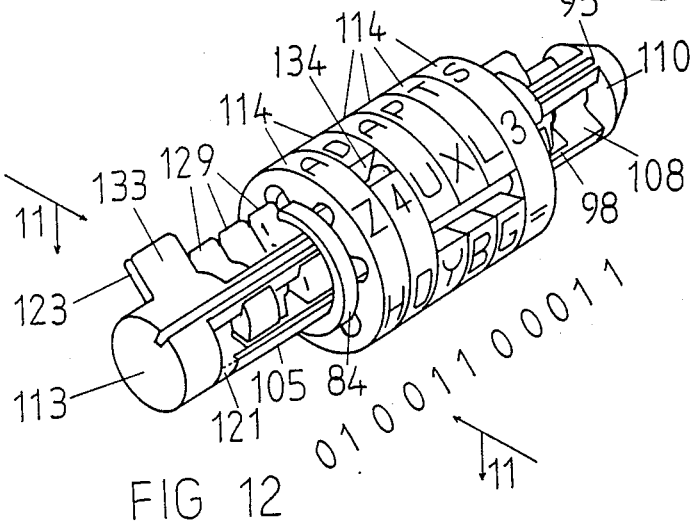

If, in the assembled form, 112 is held still at any one of said points, each 114 is rotatable on 77 through approximately fourteen degrees just, such latitude arising due to the relative proportions of the 129s and the places resembling keyways. These proportions may be delineated with reference to the plane whose intersections with features of the assembled form are depicted schematically at 15. This plane, being normal to Q, cuts a 114 that has been temporarily installed in a "1" zone, according to the scheme by which the legend of FIG. 12 was contrived.

Take any circle in this plane which is centred on Q and which has an arc cutting the 129 and the markers 126s either side of the 129. The length of this arc in the 129 should be less than 0.7 times the length thereof between the mutually facing 140s which define the 127 or 134 in which the 129 is installed, ready to abut with either of these 140s. By this readiness the 129 rotationally limits the 114 installed thereover, giving it a certain one of said modes to the exclusion of the other. Although the ratio of the arc length in the 129 to the arc length between the 140s is shown at 15 to be about 1:3, that ratio should be around 6:10 when the plane cuts centrally, by longitude of Q, the one of said congruent zones allocated to the 129, and thus concomitantly cuts the fattest part of the 129. Hence, the intersections or cuts delineated at 15 occur in a plane located closer to one of this zone's bounding planes. Toward either bounding plane, the 129 rounds.

It should be clear that each of said projectional units readily functions as an actuator. To execute said second phase, the player may grab, in one hand an element 114 having one of said modes, and in the other hand a 114 having the other mode, and then turn them about Q relative to each other. Torques can then be transmitted to the complements of the respective lots of elements through the first and second members, although slight adjustments to the positions of individuals will be required to align markers after the transition between a state in which all 129s are row-aligned and a state in which 112 abuts with 98.

An embodiment which is not illustrated with this specification is similar to the preferred embodiment, but cannot function to properly lock its obtaining projective pattern away. Briefly, the projectional units thereof, being more bulky than the ones described above, assemble on an axial tube to make a fence by the combination of their outward semi-cylindrical sides in succession; 112's counterpart is round in cross-section and defines no groove like 136; 78 has no counterpart; 105's counterpart is a round sectioned bar similar in size (cross-sectionally) to 112's counterpart and performs the function of 106 without providing support directly for the semi-tubular limiter as 77, while the counterparts of 112 and 105 are each permanently integrated at each end of the contrivance with a lateral consolidator. Said axial tube is held in the assembly at one of its ends by a flexible filament which cross-sectionally fits its bore. The player at assembly inserts this filament into the axial tube, and then fixes the tube at the other end with a releaseable peg pushed through axial bearings of the respective consolidators into the bore of the tube.

Figure 14:
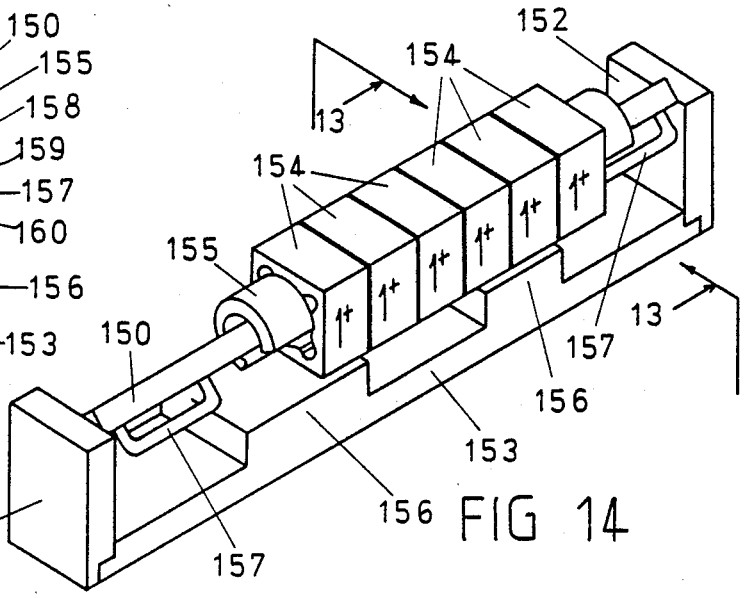

Turning to the subject of FIGS. 13 and 14, I now describe retrospectively the practice embodiment having its form.

There was provided a long rigid linear wooden fence 150 rotatably fixed at its ends between the rigid upright wooden flanges 151 and 152 through screws which could easily rotate in bearings of the respective flanges. 151 and 152 were rigidly and durably located against the long linear flat-bottomed wooden base 153, at whose ends the respective flanges were attached by glue. Fence 150 was engaged horizontally if 153 was put bottom down on the horizontal table at which I worked, to delimit a horizontal path for the succession of wheel-like or annular elements 154s.

The semi-tubular limiter on which these elements were permanently held was like 77 with a narrower gap, and without 78; the longitudinal edges of 150 were kept slidably in contact with the inward concave surface of this limiter 155, all the way along this surface in parallel to the axis of rotation of 150 relative to 153, and 155 provided each 154 with its journal whereon it could rotate, virtually about this same axis.

Due to the flat-topped block-like barriers 156s glued onto the top of 153, and the rectangularly embowed, row-aligned metallic barriers 157s formed from circular-section rod and embedded in 150, the markers 158s of the 154s were restrained, as with the other embodiments described. In this case the restraint was effected also by the flanges 151 and 152 which delimited the length of the paths available for the respective rows of 158s on 155 during said first phase.

The top of each 156 was generally parallel to the bottom of 153 and was to be close to a segment of the indicator's bottom face to prevent selectable 154s from rotating any more than an inconsequential amount relative to 153. Further, 157s were able to move through the gap defined between sides 159 and 160 of 155 to directly move 154s in simultaneous rotation above 153.

Each 154 had a regular rectangular, or cross-sectionally square rim, and defined maximally four congruent, regularly spaced places resembling keyways, each of which could be installed on at least one of the 157s, for rotation through 90, 180, 270, or even 360 degrees in one continuous rotation, relative to 153 accordingly.

The edges of the 154s were not acutely sharp, as would be expected in device of this nature.

Each 154 was outwardly marked with the integers 1,2, and 3 which appeared respectively on three successive ones of its said facets to aid in solving the puzzle, or obtaining a full row of unmarked facets (as shown at 14) in the top face of the indicator. At 14, such integers are shown indexed with the sign +.

The robustness of this apparatus should make it useful as a toy for children developing spatial perception through observation of the changing relations of controllable elements in moves, as well as serving as a possible early introduction means to mathematical variables.

So far I have consistently shown a long member extending through the bore of each wheel-like element in the indicator but a puzzle of this invention is conceivable in which no fence passes through the bores of the wheel-like elements, but in which a fence and slide gadget are mounted below the indicator's passage to regulate movement of the indicator.

You might ask whether the annular elements such as 114s or 154s fit the description of portions slidably retained. In none of the assembled embodiments I have thus far described do the 'elements' themselves slide; it is rather the semi-tubular limiter on which they are mounted which is the slidable part. The wheel-like elements of the following embodiment are slid themselves in said first phase.

An embodiment similar in its overall appearance to the subject of 13 and 14 comprised maximally nine wheel-like elements mounted coaxially on a part of a semi-tubular limiter terminated at each of its ends rigidly fixed to a short spindle which was rotatably seated in a bearing defined by a mounting flange. While disposed through the bore of each of these wheel-like elements, said part was hollow, circularly cylindrical overall, and defined diametrically opposite linear slits parallel to the common rotational axis, which slits enabled limited communication between the hollow core and the exterior. Largely inside said part was a fence incorporating flanges projecting radially outward through respective ones of the slits to respective ends of the indicator. Each such flange held a lip which spread out a little to confine the annular elements to successively contiguous positions for rotation of a lot on the fitting journal of said part. At a singular end holes were defined through which respective ones of the retaining lips of the fence could be pressed.

On a more wide-ranging note, if a puzzle made possible with an indicator and exclusion facility therefor along the lines described is to challenge a mature intellect, its indicator should comprise at least six annular elements, ie.n such ones, but there is no need to have exactly 2n-1 zones for them associated with modes as described. An apparatus whose indicator consists of only six such elements is not designed to be an extensive challenge for a genius.

The invention as set forth in the claims may be reduced to practice as you wish and the following information serves to illustrate how some of the facets of the preferred embodiments could be modified without departing from the scope of the invention.

(1) A rigid, flat, eccentric washer could replace closure 95 with an extension of groove 136 through to an opening of it at said first end of the apparatus. Such a washer has a central hole which bears on 111 while the washer is engaged by longitude of Q between consolidators 110 and 108, being rotationally locked onto one of these consolidators by means of a protuberance of this consolidator which seats in either one of two recesses defined for it by the washer. At assembly the player chooses which face of the washer is put directly against 110, therefore which one of these recesses accomodates the protuberance, and therefore whethter the radially jutting outward projection of the washer is stationed ready to abut with and obstruct 77, preventing its removal via the first end of the apparatus, or is rather stationed to pass through gap 89, thus allowing the indicator to be removed at will, quashing the necessity to make the solution state first.

(2) Possibly said delayer means could be omitted. Without 122, 107 should extend into a hole defined for it by 113. Such a hhole would allow 107 to enter via a path transverse to the rotational axis.

(3) A detent spring could be deployed to aid in placement of the indicator longitudinally of Q for conditioning via rotation of the first relative to the second member, however such a device is strictly unnecessary, as the constructor should find if the invention is reduced to practice with the latitudes obtaining as described. Such latitudes could perhaps be achieved by making each 129 to span fully its allocated zone and making each 140 to span only seven-tenths of any such zone. In this case each wheel-like element 114 would be wider at its outward rim than at its annular array of markers.

(4) A replacement set for 123,133 and 134 comprises a singular obstruction on said delayer means or on 105, which obstruction is designed to subtend a greater angle at Q than each place resembling a keyway existent through 126s, except for one of each 114, which one is made to overpass this obstruction by being larger at its lower opening, although not larger than the others in its upper. Laterally opposite and cooperating with this obstruction, a projection integrated with the second member may be installed in any of the places resembling keyways, and prevents relative rotation of the long members when this obstruction directly engages with a 114, by installation in the special place.

(5) Possibly 107 could be dispensed with by making approximately half of the projectional units with small axial spindles protruding to fit axial bearings in units of the other half. Provision could be made for securing those selected for the first attitude to 106 by means of a long lip at the face of 106 closest to the rotational axis. Such a lip would jut out to subtend a greater angle at this axis than the rest of 106, and a fitting recess or notch at the base of 130 and 131 would allow any of the projectional units to be locked onto 106 by placement of this lip into this recess or notch during assembly of the components by the player. Alternatively, such a lip could be utilized to enable 107 to be less rigid than I specified.

What is claimed is:

1. A manipulative puzzle
which comprises a first member and a second member,
which comprises a set of annular elements, and which displays a form
in which said elements are coaxially pinned,
in which said members are mutually engaged longitudinally of the common axis of said elements,
in which said second member is pivoted for rotation in relation to said first,
and in which said members penetrate common zones in line lengthwise of said axis, in each of which zones there is a barrier extending from one of said members to rotationally limit the one of said elements, if any, which is installed in the zone,
whereby, given said form, certain rotations of said second member relative to said first permit respective rotations of an exclusive lot of said elements, the make-up of which lot is variable by movements of said elements, each from one of said zones to another,
whereas the number of said elements in said set is more than two.

2. A manipulative puzzle as set forth in claim 1,
which comprises an semi-tubular limiter subtending more than two hundred degrees at said axis in a plane orthogonal to said axis,
whereas said limiter provides an equable foundation for said set,
and whereas said limiter is slidably in contact with a fence whereby said set is moveable longitudinally of said axis to vary the make-up of said lot.

3. A manipulative puzzle as set forth in claim 2,
whereas said set comprises five ones of said elements, each rotatable about said axis in relation to each of the others,
whereas each of said elements defines four places resembling keyways of which one is formed with a different trait than the other three,
whereas, in said form, said set rings said fence,
and whereas, depending on the respective rotational positions
of said elements in relation to said first member, said limiter and said fence can be disjoined in consequence of said trait.

4. A manipulative puzzle as set forth in claim 3,
whereas one of said elements is excluded from said lot by means of a barrier which protrudes from said first member generally toward said axis.

5. A manipulative puzzle as set forth in claim 3,
whereas, in said form, each of said elements rings each of said members,
whereas said limiter is fitted with a ridge which protrudes approximately toward said axis from an inward surface of said limiter,
and whereas, at each of said rotations, said second member engages said limiter, by means of said ridge, in simultaneous rotation therewith about said axis in relation to said first member.

6. A manipulative puzzle as set forth in claim 3,
which comprises a (manually isolable) projectional unit,
whereas said unit comprises a hub means, a barrier and a lug,
whereas said hub means defines an axial orifice,
whereas said lug defines a recess which is separated from said orifice by said hub means,
whereas said barrier extends away from said orifice to a greater extent than said lug in order to abut, at successive ones of said rotations, with respectively different ones of said elements,
and whereas said fence, being a part of said first member, subtends more than ninety degrees at said axis in a plane orthogonal to said axis, and has a surface facing toward said axis, said surface adjoining a ridge which protrudes from said surface toward said axis to penetrate said recess and thereby rotationally engage said unit with said fence.

7. A manipulative puzzle as set forth in claim 3,
wherein said limiter comprises a pair of resilient members, each having a convex surface which forms part of the journal for one of said elements in said form, whereas, after disjoining said limiter and said fence, said set can be readily unpinned from said limiter by pressing said resilient members toward each other.

8. A manipulative puzzle as set forth in claim 1, wherein said set is ready to be installed at five different stations relative to said first member so that said lot can be made up as each one of five respectively different subsets of said set.

9. A manipulative puzzle as set forth in claim 8, wherein one of said elements defines a place resembling a keyway and is excluded from said lot by means of a barrier which protrudes from said first member in a direction away from said axis to penetrate said place.

10. A manipulative puzzle as set forth in claim 8, whereas said form is configured to be reassembled to incorporate any choice of one out of a plurality of different projective patterns which can obtain to limit the make-up of said lot to respectively different ranges of the subsets of said set, for respective terms in each of which, said rotations can be readily executed.

11. A manipulative puzzle as set forth in claim 10, whereas the number of said elements in said set is more than five, each of said elements being rotatable in said form in relation to each of the others.

12. A manipulative puzzle as set forth in claim 11, whereas, in said form, each of said elements rings each of said members.

13. A manipulative puzzle as set forth in claim 8, wherein each of said elements comprises an array of protuberant markers, and whereas, at successive ones of said rotations, said members are respectively designated to communicate rotation to ones of said elements when separated by a further one of said elements as it changes one of its said markers for another in relation to the designated member.

14. A manipulative puzzle as set forth in claim 13, whereas said lot is continuously rotated through two hundred and forty degrees about said axis in relation to said first member at each of said rotations.

15. A manipulative puzzle as set forth in claim 14, wherein each of said elements boldly registers a number on its rim, whereas said number is set to contribute to a row of numbers running parallel to said axis.

16. A manipulative puzzle which comprises five similar coaxial elements, which comprises a base supporting a barrier ready to abut with one of said elements at a facet of the element which faces away from their common axis, whereas said elements are pinned together side by side on a semi-tubular limiter which defines a gap transgressed by a barrier ringed by one of said elements, whereas said barriers engender respectively different modes of rotational limitation for respectively selected ones of said elements, whereas said limiter is set to be (slided) slid on a fence ringed by one of said elements, and whereas said fence is pivoted for rotation in relation to said base.

17. A manipulative puzzle as set forth in claim 15, wherein said facet is one of four largely flat facets arranged about said axis so that the outline of the element which has said facets, in a plane perpendicular to said axis, is virtually square.

18. A manipulative mathematical puzzle which comprises a first member and a second member, which is configured to form a facilty comprising a projective pattern and a sum, and which comprises a plurality of units in which each unit is configured to be installed in said facility in any choice of attitude out of the pair consisting of a first attitude and a second attitude, whereas in said sum said first member is pivoted on said second member for rotation relative thereto about an axis, and said second member is mutually engaged to said first member longitudinally of said axis, whereas in said pattern said units are engaged, longitudinally of said axis to said sum, in respective serial positions, to produce two rows of similar barriers running parallel to said axis, in each of which rows the barriers generally protrude away from said axis, whereas in said pattern said units form, in order longitudinally of said axis:

a first part in which each unit is installed in said first attitude;

a second part in which each unit is installed in said second attitude;

a third part in which each unit is installed in said first attitude;

and a fourth part in which each unit is installed in said second attitude;

whereas each unit installed in said first attitude is engaged to said first member for simultaneous rotation therewith relative to said second member, whereas each unit installed in said second attitude is rotationally engaged to said second member for simultaneous rotation therewith in relation to said first member, whereas each of said barriers penetrates and transgresses a linear annular region which rings said sum, and whereas, each of said units comprises one of said barriers.

19. A manipulative puzzle as set forth in claim 18, which comprises a set of annular elements configured to form an indicator which rings said facility, whereas in said indicator said elements are coaxially pinned together to be in successive positions longitudinally of their common axis and each of said elements comprises an outer ring from which a marker protrudes toward said axis to abut with a selected one of said barriers in simultaneous rotation with one of said members, relative to the other one of said members.

20. A manipulative puzzle as set forth in claim 19, which comprises a semi-tubular limiter configured to integrate said indicator while subtending more than two hundred and fifty degrees at said axis in a plane orthogonal to said axis, said limiter defining a gap for some of said barriers to moveably penetrate as said indicator rings said facility and is impounded on said limiter.

21. A manipulative puzzle as set forth in claim 20, whereas the nuumber of said elements in said indicator is six, each of said elements being rotatable, while ringing said facility, in relation to each of the others, and whereas said limiter is configured to slide on said first member so that said indicator can be readily moved in relation to said pattern.

* * * * *